United States Patent [19]

Kunimoto

[11] 4,381,652

[45] May 3, 1983

[54] DEMAND FLOW CRYOSTAT

[75] Inventor: Wallace Y. Kunimoto, Santa Barbara, Calif.

[73] Assignee: Santa Barbara Research Center, Goleta, Calif.

[21] Appl. No.: 339,345

[22] Filed: Jan. 15, 1982

[51] Int. Cl.[3] ..... F25B 19/00

[52] U.S. Cl. ..... 62/514 JT; 62/48

[58] Field of Search ..... 62/514 JT, 48

[56] References Cited

U.S. PATENT DOCUMENTS

| | | | |
|---|---|---|---|
| 3,257,823 | 6/1966 | Hogan | 62/514 JT |
| 3,640,091 | 2/1972 | Buller et al. | 62/514 JT |
| 3,704,597 | 12/1972 | Nicholds | 62/514 JT |
| 3,747,365 | 7/1973 | Nicholds | 62/514 JT |
| 3,800,552 | 4/1974 | Sollami et al. | 62/514 JT |

*Primary Examiner*—Ronald C. Capossela

*Attorney, Agent, or Firm*—Allen A. Dicke, Jr.; William J. Bethurum; Anthony W. Karambelas

[57] ABSTRACT

Demand flow cryostat 10 has an expansion nozzle 24 from which flow is controlled by valve needle 32. Bellows 34 regulates flow to maintain substantially constant temperature in the cooled space adjacent interior surface 26. Guide tube 38 and felt 44 control flow of the mixed liquid-vapor cryogen to stabilize temperature at the electronic device 30 which is cooled by the cryostat.

7 Claims, 5 Drawing Figures

DEMAND FLOW CRYOSTAT

BACKGROUND OF THE INVENTION

Technical Field of the Invention

This invention is directed to a demand flow Joule-Thomson cryostat having structure adjacent the expansion nozzle to control flow of the liquid and gaseous cryogen to stabilize temperature at the point of refrigeration load.

J. S. Buller, M. J. Nagy and E. W. Peterson, U.S. Pat. No. 3,640,091 shows a Joule-Thomson cryostat assembly which has a finned cryogen delivery tube spirally surrounding an internal cylinder. The terminating end of the tube is at an expansion nozzle located adjacent to the refrigeration load. The central cylinder contains a temperature sensitive device, such as a bellows having a fluid therein which changes pressure with temperature. Attached to the bellows is an expansion valve needle in operative relationship with the expansion nozzle. As the temperature at the bellows varies, in accordance with cryogen flowing away from the expansion valve, the bellows controls the amount of cryogen expanding out of the expansion nozzle. Values are chosen to stabilize the temperature at a point where the outflow from the expansion nozzle is a mixed fluid of liquid and gas. For example, when nitrogen is used as the cryogenic fluid, a suitable temperature is 77° Kelvin.

When the thermal load being cooled by the cold finger is an electronic device, the stability of the function of the device is related to the stability of the temperature. In devices such as infrared detectors, changes in temperature change the sensitivity to result in electronic instability and electronic noise. It is desirable to maintain the temperature of the detector as constant as possible to eliminate this variable from the operation of the device. As is described hereafter, the temperature of the prior art devices has not been as closely controlled as possible.

SUMMARY

In order to aid in the understanding of this invention, it can be stated in essentially summary form that it is directed to a demand flow cryostat with flow control means at the cryogen expansion nozzle to stabilize the temperature at the thermal load adjacent the expansion nozzle.

It is an advantage and purpose of this invention to provide a demand flow cryostat with a temperature controlled Joule-Thomson expansion nozzle, and with cryogen flow control means positioned between the expansion nozzle and the thermal refrigeration load to stabilize the refrigeration produced at the refrigeration load to maintain a stabilized temperature at the refrigeration load.

It is another purpose and advantage of this invention to provide such a cryostat wherein the cryogen expanding from the Joule-Thomson expansion nozzle is mixed vapor and liquid cryogen and felt as positioned adjacent the thermal load to prevent the liquid from directly impinging at the thermal load point to aid in stabilizing the temperature.

Other advantages and purposes of this invention will become apparent from a study of the following portion of this specification, the claims and the attached drawings.

DESCRIPTION OF THE PREFERRED EMBODIMENT

Figure 2:
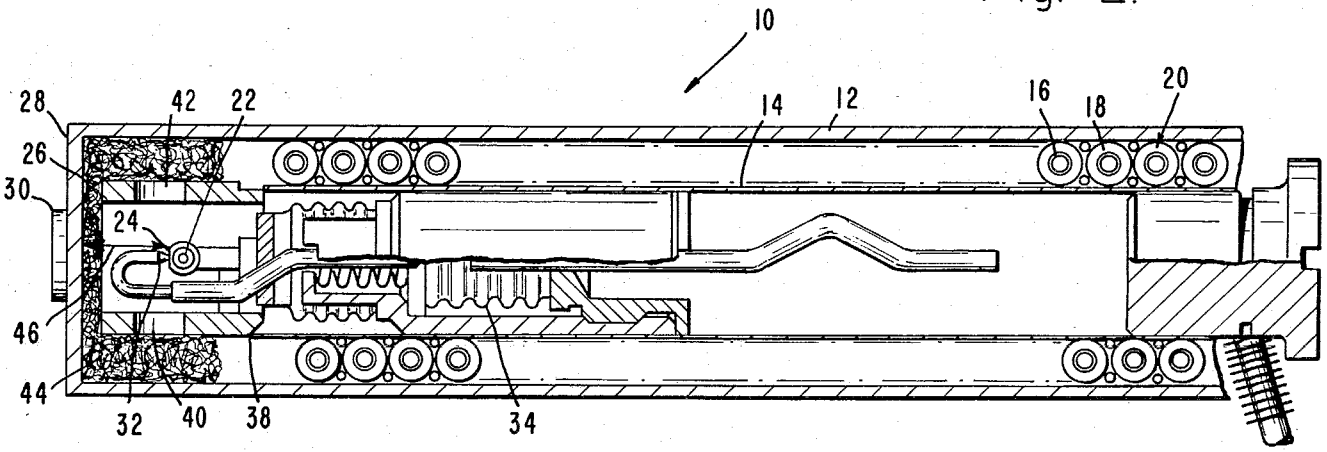
FIG. 2 is a longitudinal section through the demand flow cryostat of this invention.

The demand flow cryostat of this invention is generally indicated at 10 in FIG. 2. It is structurally similar to the cryostat shown in J. S. Buller et al. U.S. Pat. No. 3,640,091, the entire disclosure which is incorporated herein by this reference. Cryostat 10 has an outer cylindrical tubular housing 12 and an inner tubular cylindrical mandrel 14. Tube 16 carries fins 18 thereon, usually spirally wrapped to form finned tube assembly 20. The finned tube assembly 20 is spirally wrapped around mandrel 14 where its forward end terminates in plug 22. Expansion nozzle 24 faces forward so that outflow is directed generally against the interior surface 26 of end wall 28 secured to outer housing tube 12. The refrigerated heat load is secured to end wall 28. In the illustrated case, the heat load is a cooled electronic device 30 such as an infrared radiation detector. It is understood that the cryostat 10 is enclosed in a suitable insulating housing, such as a dewar. In order to control the temperature and to conserve gas flow, valve needle 32 is positioned to control outflow from expansion nozzle 24. Valve needle 32 is mounted on bellows 34 so that outflow through expansion nozzle 24 is reduced when the desired temperature is reached.

Figure 1:
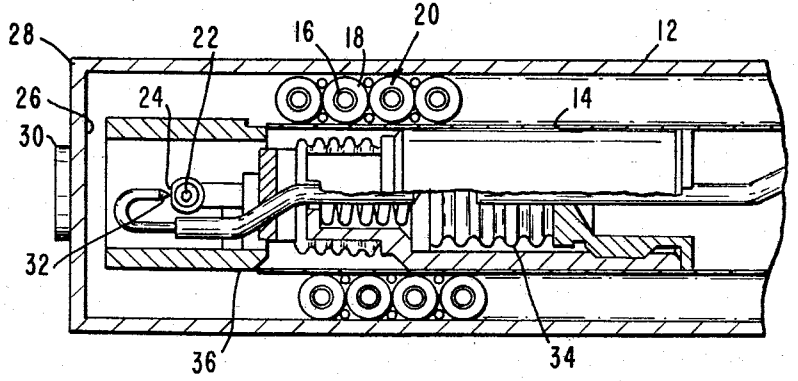
FIG. 1 is a longitudinal section through a demand flow cryostat prior to this invention.

The structure thus far described is shown in J. S. Buller et al. U.S. Pat. No. 3,640,091 and is also shown in FIG. 1. The flow of the cryogen onto the interior surface 26 must be controlled in order to provide uniform delivery of refrigeration. At design temperature, the cryogen is a mixed vapor and liquid. In FIG. 1, the control is accomplished by tube 36 which surrounds expansion nozzle 24 and has an open end directed toward the interior surface 26. Guide tube 36 thus directs all flow onto interior surface 26. After the cryogen leaves the region in which the useful refrigeration is produced, it moves to the right through fins 18 in counterflow heat exchange relationship to the incoming cryogen in tube 16.

FIG. 2 shows a similar cryostat described with the same reference characters. In addition, it illustrates the improved control of the cryogen of this invention as the cryogen flows from nozzle 24 into the region adjacent end wall 28 where the useful refrigeration is produced. Guide tube 38 is made of insulator material is secured on the left end of mandrel 14 and terminates closely adjacent the interior surface 26 so that the principal cryogen flow is directed onto interior surface 26 on the opposite side of wall 28 from electronic device 30. In addition, the sides of guide tube 38 are perforated with openings 40 and 42. Furthermore, felt 44 is positioned against wall 26 and around guide tube 38. Felt 44 is a low density felt which prevents liquid cryogen from splashing on the temperature control valve. The felt holds the liquid cryogen adjacent the interior surface 26 where the refrigeration is wanted, and the liquid vaporizes in the felt to produce the refrigeration at the desired point. The use of the felt decreases the range of temperature fluctuation and the rate of change of temperature at the electronic device 30. This is accomplished without an appreciable increase in the thermal mass which would otherwise increase cool-down time. The use of felt results in a decrease in vapor pressure in the region to be cooled by retaining the liquid cryogen in close proximity to the interior surface 26 where the refrigeration is needed, so that the vaporization is accomplished where the refrigeration is desired. Without the felt, excess liquid cryogen is usually carried out with the overflowing gas into fins 18. This liquid in the fins increases the pressure in the outflowing stream so that the pressure in the region to be cooled is higher. The higher pressure in the region to be cooled adjacent surface 26 opposite electronic device 30, causes an increase in temperature. A one atmosphere change in pressure in the region to be cooled causes approximately a 14° Kelvin change in temperature when the cryogen is nitrogen. With the use of felt 44 and the openings 40 and 42 in guide tube 38, temperature at electronic device 30 is stabilized.

Figure 3:
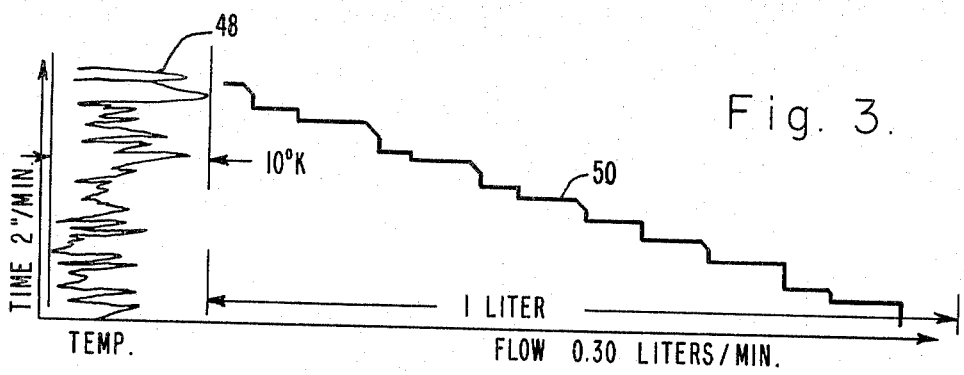
FIG. 3 is a graph of the temperature versus time at heat load 75 in U.S. Pat. No. 3,640,091, and of the flow versus time in chamber 24 of that patent.
Figure 4:
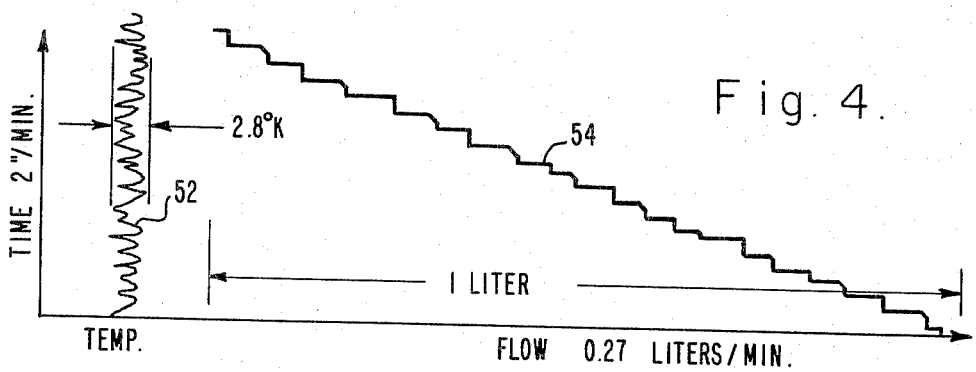
FIG. 4 is a similar graph of temperature versus time and of flow versus time with a structure shown in FIG. 1.
Figure 5:
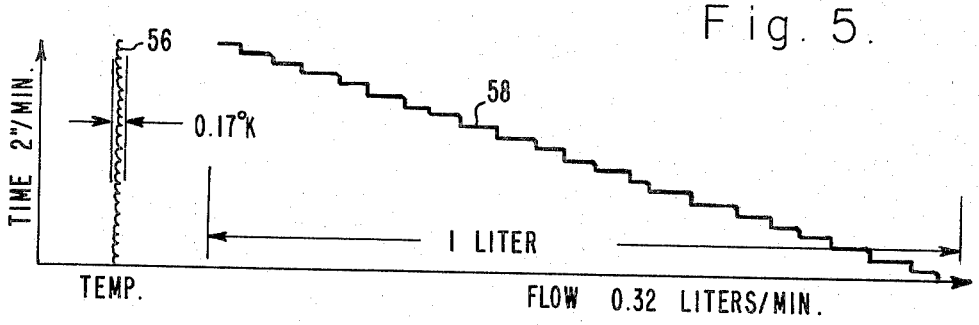
FIG. 5 is a similar graph of temperature versus time and of flow versus time with the structure of this invention shown in FIG. 2.

FIG. 3 illustrates the temperature changes found in Buller U.S. Pat. No. 3,640,091 at infrared detector 75. Temperature line 48 shows a 10° K. temperature variation. Flow line 50 shows the flow of nitrogen gas to the detector. Chart speed was 2 inches per minute and nitrogen gas flow was 0.30 liters per minute. The total length of flow line 50 along the abscissa is about 1 liter. FIG. 4 shows temperature line 52 and flow line 54 of a cryostat structure as shown in FIG. 1. The temperature fluctuations of temperature line 52 are about 2.8° Kelvin. FIG. 5 shows temperature line 56 and flow line 58 of the structure of this invention illustrated in FIG. 2. These steps are very much closer in the flow line 58, indicating smaller flow steps and the temperature fluctuations indicated by temperature line 58 show a temperature fluctuation at the electronic device 30 of 0.17° Kelvin. This is very much better than the prior art structures and this improvement is produced by the guide tube 38 with its properly positioned side openings 40 and 42 and the proper felt 44 in the correct position.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A demand flow cryostat comprising:

a tubular outer housing having a support thereon for supporting an electronic device to be cooled;

an expansion nozzle directed toward said support, a tube connected to said expansion nozzle for delivering pressurized cryogen to said expansion nozzle;

a valve needle positioned adjacent said expansion nozzle for controlling the outflow of pressurized cryogen from said expansion nozzle, a temperature sensor positioned to sense the temperature in the region to be cooled adjacent said support, said temperature sensor being connected to said valve needle in said nozzle to control the outflow of cryogen from said expansion nozzle to control the amount of cooling in the space to be cooled adjacent said support; and cryogen flow control means positioned around said expansion nozzle and within the space to be cooled adjacent said support for controlling the flow of cryogen away from said nozzle to stabilize temperature at said support, said flow control means comprising a perforated tube having an open end positioned around said nozzle with its open end directed toward said support and its perforations directed away from said support, said flow control means also including felt positioned within said outer housing and positioned against said support.

2. The demand flow cryostat of claim 1 wherein said felt is selected from the group consisting of hair felt, metallic felt and synthetic polymer composition material felt.

3. The demand flow cryostat of claim 2 wherein said guide tube is made of low thermal conductivity nonmetallic material.

4. The demand flow cryostat of claim 1 wherein said guide tube is made of low thermal conductivity nonmetallic material.

5. The demand flow cryostat of claim 2 wherein a mandrel is positioned within said outer housing, said cryogen supply tube having fins on a portion thereof and said finned portion of said supply tube being spirally wound around said mandrel and fitting within said outer housing so that cryogen flowing away from the region to be refrigerated passes past said fins to cool pressurized cryogen being delivered to said expansion nozzle.

6. The demand flow cryostat of claim 1 wherein a mandrel is positioned within said outer housing, said cryogen supply tube having fins on a portion thereof and said finned portion of said supply tube being spirally wound around said mandrel and fitting within said outer housing so that cryogen flowing away from the region to be refrigerated passes past said fins to cool pressurized cryogen being delivered to said expansion nozzle.

7. The demand flow cryostat of claim 6 wherein said support for an electrode device positioned at the region to be refrigerated is a closure end wall of said outer housing so that the interior of said outer housing at said end wall is the region to be cooled and the electronic device is secured on the exterior of said end wall.

* * * * *